United States Patent [19]

Müller

[11] 4,057,084

[45] Nov. 8, 1977

[54] JACQUARD-HARNESS OF A WEAVING MACHINE

[75] Inventor: Otto Müller, Utikon am See, Switzerland

[73] Assignee: Stäuble Ltd., Horgen-Zurich, Switzerland

[21] Appl. No.: 693,549

[22] Filed: June 7, 1976

[30] Foreign Application Priority Data

June 12, 1975 Switzerland ..... 7595/75

[51] Int. Cl.[2] ..... D03C 3/00; D03C 3/38

[52] U.S. Cl. ..... 139/59; 139/86

[58] Field of Search ..... 139/59–65, 139/86, 85, 55 R; 28/54

[56] References Cited

FOREIGN PATENT DOCUMENTS

| | | | |
|---|---|---|---|
| 201,132 | 8/1908 | Germany | 139/86 |
| 140,500 | 4/1903 | Germany | 139/86 |
| 45,836 | 9/1919 | Sweden | 139/86 |
| 1,209,589 | 10/1970 | United Kingdom | 139/86 |
| 151,761 | 10/1920 | United Kingdom | 139/86 |

*Primary Examiner*—James Kee Chi

*Attorney, Agent, or Firm*—Blanchard, Flynn, Thiel, Boutell & Tanis

[57] ABSTRACT

An improvement in a Jacquard-harness of a weaving machine in which the spacing of the heddles for adjusting the width of the material are adjustable. The harness is composed of a plurality of series arranged comber boards each having guide bores therein adapted to receive a harness cord therein. A connection is provided between a pair of such comber boards and consists of rigid, non-bending connecting rods each connected through a pivotal joint. A comber board is secured to a shaft which forms the pivotal joint. A portion of the bores in the comber boards lies on the axis of the shaft which also constitutes the central axis of the comber board. The remaining bores in the comber board are arranged in a mirror image manner symmetrical to the plane connecting the center lines of the comber boards.

8 Claims, 4 Drawing Figures

JACQUARD-HARNESS OF A WEAVING MACHINE

FIELD OF THE INVENTION

The invention relates to a Jacquard-harness of a weaving machine, in which the spacing of the heddles for adjusting the chosen material width are movable and adjustable preferably in the width of the machine, whereby the movable harness has in the area of the harness cords a plurality of series arranged comber boards, which are arranged one behind the other and having a guide bore per harness cord therein.

BACKGROUND OF THE INVENTION

It is common to weave names, trade names or trademarks into the fabric edges of certain fabrics. A name weaving machine (edge Jacquard) is used for this purpose. Such a machine can be compared with a Jacquard machine which is reduced in size, in which in most cases less than 100 sinkers are installed. The name weaving machine is arranged advantageously laterally in modern weaving machines, and the connection between the ends of the sinkers and the heddles is done by known harness cords. Such cords are guided in guide or comber boards in order to have at both ends a direction which is suitable with respect to the position of the sinkers and heddles. It is thereby often necessary to guide the cords around parts of the weaving machine, so that contact or wear is avoided.

If on one and the same weaving machine fabrics of different widths are manufactured successively, it is necessary to adjust the heddles of the Jacquard part which effects the weaving in of the names or marks to the new fabric width or the new edge spacing. The normal position of the thread guides of the heddles is thereby supposed to remain unchanged, in particular with respect to their height from the crank shaft. In order to reach this goal, one has to newly tie, with a resulting high amount of work input, the harness cord lengths for the new conditions.

Therefore, solutions were searched to bypass this required work load. According to Swiss Pat. No. 460 659, each harness cord is guided for this purpose in a separate tube. However, due to the great friction between cord and tube wall, each heddle must now have a particularly strong pull-back member, which retroactively requires a stronger and heavier built name weaving machine.

A different suggestion for a solution is described in Swiss Pat. No. 485 888. Here the harness cords are guided by means of many comber boards which are arranged one behind the other, which comber boards are connected to a flexible harness guide system by semi-rigid, elastic and flexible rods. In this arrangement, the guide threads do not remain at the same height during an adjustment of the heddles. A resetting of the individual harness cords is necessary, which is very energy expending. In addition, the support for the comber boards does not permit a strong diverting of the cords on a short stretch without causing a weakening of the support and reducing the stability.

The purpose of the invention is to provide a harness which can be adjusted easily and in many ways whereby the thread guides of adjacent heddles remain at the same height.

This purpose is attained in a Jacquard-harness of the above-mentioned type by a connection between each two comber boards which are arranged one behind the other consisting of rigid, namely bend-resistant connecting rods which are connected with one another by pivotal joints in the area of the comber boards, whereby the center line of each comber board coincides with the pivot axis of the pivotal joint connection of adjacent connecting rods and the guide bores in the comber boards are arranged one behind the other and are each associated with a harness cord and lie at mirror image symmetrical to the connecting plane connecting the center lines of the comber boards.

Each joint pivot axis is connected to a spring or the like which adjusts the unlocked joint and, as a result, the comber board which is secured to a shaft forming the pivotal joint, to a position bisecting the angle which is formed by the adjacent connecting rods.

BRIEF DESCRIPTION OF THE DRAWINGS

One exemplary embodiment of the subject matter of the invention is illustrated in the drawings, in which.

DETAILED DESCRIPTION

Figure 1:
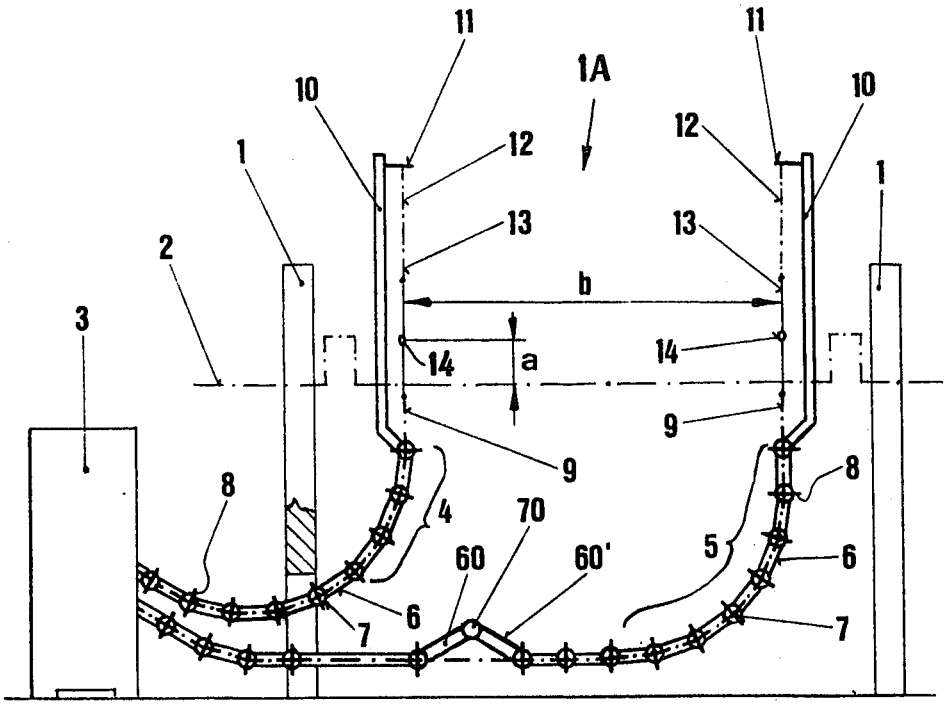
FIG. 1 illustrates schematically a loom having a laterally arranged name weaving machine operable on the Jacquard principle and a harness guide system to the laterally movable edge heddles.

FIG. 1 schematically illustrates a weaving machine 1A between its frame walls 1 and having a crankshaft 2 therein. A name weaving machine 3, for example, is arranged at the side of the weaving machine 1A. A harness guide system 4 extends from the name weaving machine to the left side (FIG. 1) of the not illustrated fabric which is being woven in the machine 1A and a harness guide system 5 extends to the right side of the fabric. The harness guide systems 4 and 5 each consist of rigid connecting rods 6, joints 7 which connect the rods 6 and guide or comber boards 8 which guide the harness cords. Only a single harness cord 9 is illustrated in FIG. 1. A bent or angled carrier rod 10 is connected to the end of each harness guide system 4 and 5 adjacent the harness cords. The free end of the carrier rod 10 is secured to an anchor plate 11. Elastic return elements 12 are secured to and extend between the anchor plate 11 and the schematically illustrated heddles 13. In addition, each heddle 13 is knotted together with or secured to a harness cord 9. The thread guides 14 are aligned at the same level and are spaced at a distance "*a*" from the crankshaft 2. The thread guides 2 are spaced at a distance "*b*" from one another, which distance corresponds to the distance from one weaving edge to the other on the not illustrated material.

The carrier rods 10 for the entire harness are fixedly connected to the weaving machine in a manner not shown and can be adjusted with respect to one another to change their reciprocal distance from one another, so that the heddle package assumes the respectively desired distance "*b*," which corresponds to the distance between the weaving edges. Also individual connecting rods 6 can be fixedly connected to the weaving machine to fix the harness guide systems 4 and 5.

Figure 2:
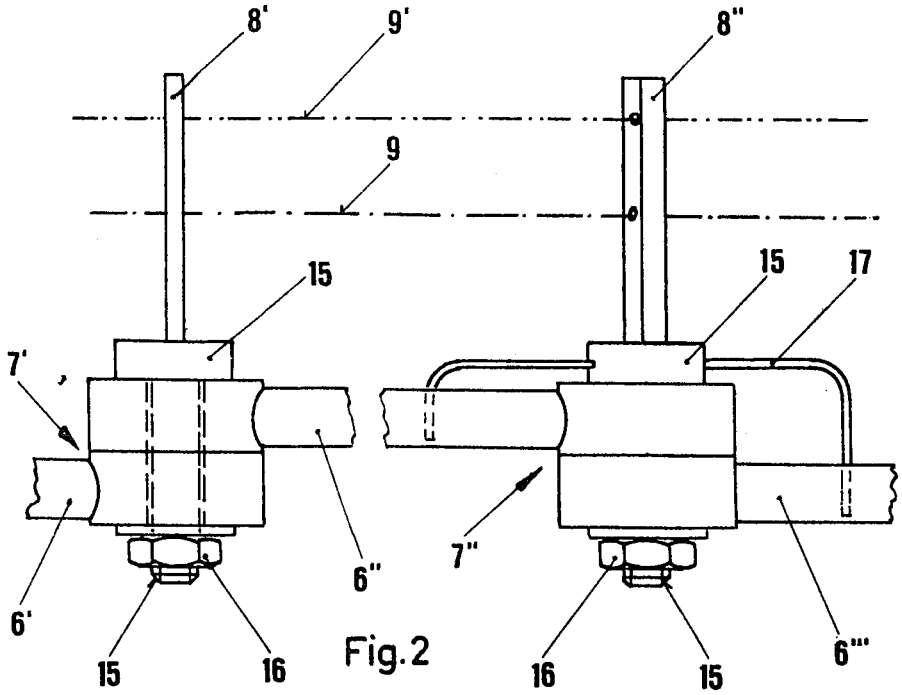
FIGS. 2A and 2B illustrate enlarged side views of two adjacent joints having comber boards in the harness guide system.
Figure 3:
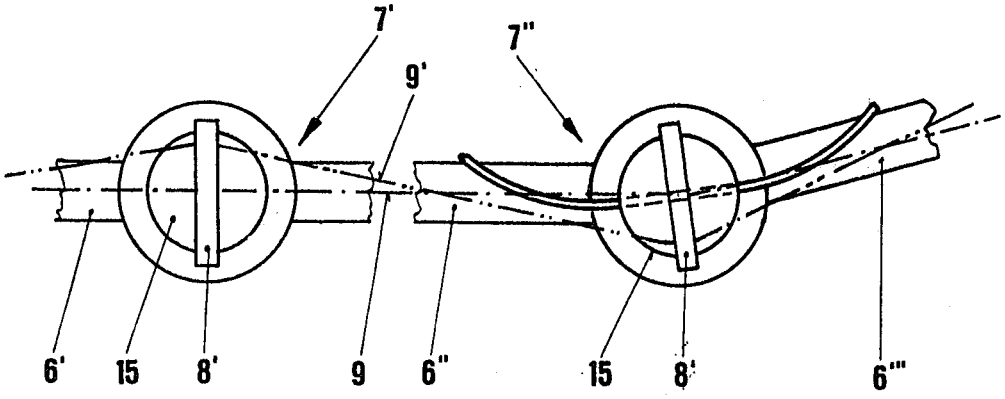
FIG. 3 is a top view of the joints shown in FIG. 2.
Figure 4:
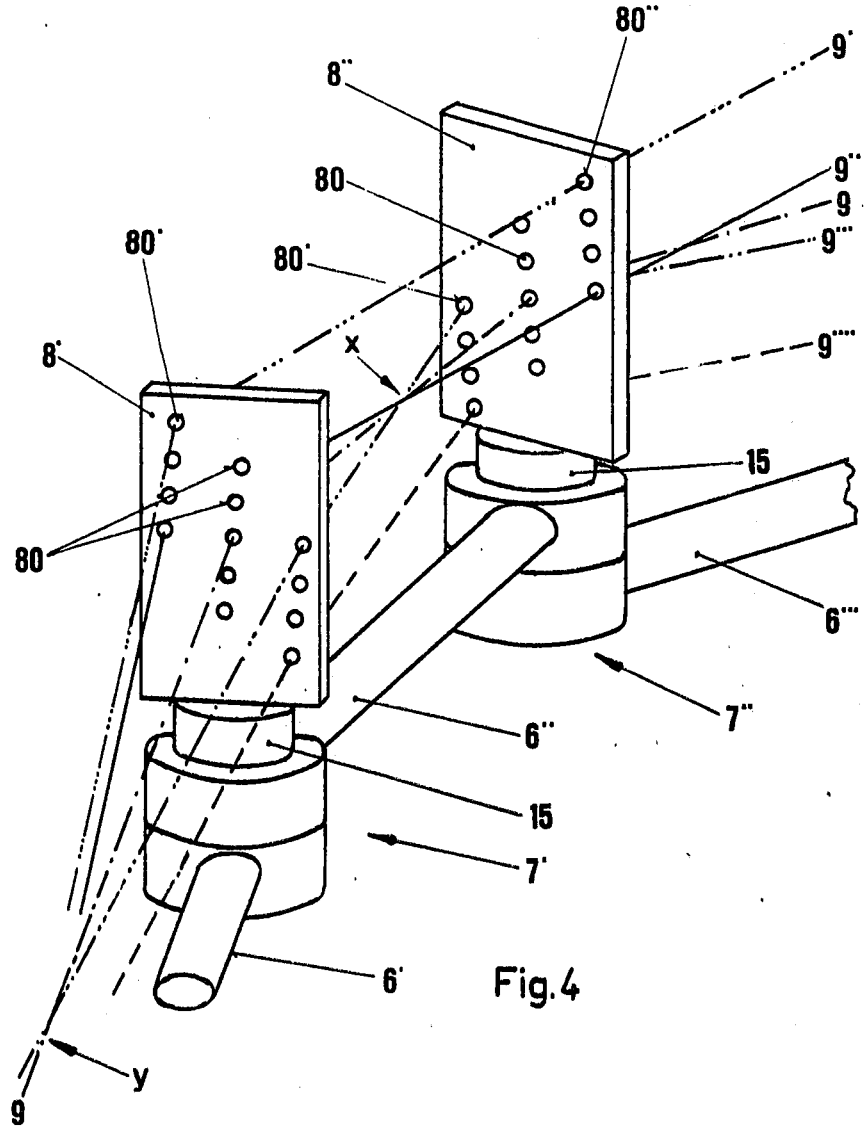
FIG. 4 is a perspective view of two successive comber boards, from which the course of the individual harness cords of the harness are illustrated.

FIGS. 2 to 4 illustrate a portion of the harness guide system in the area of the harness cords. The drawing illustrates two joints 7′ and 7″ which are arranged one behind the other and which are separated by rigid, that is bend-resistant, connecting rods 6″. Reference numerals 6′ and 6″ identify the further adjacent connecting rods. Each of the rods 6 has at both ends thereof a bearing housing which receives a shaft member 15 to form several rotatable joints 7′, 7″ in the harness guide systems. Nuts 16 are used to lock the joints 7′, 7″ in an adjusted position. A comber board 8′ or 8″ is fixedly mounted on the shaft member 15.

For an operation of the device, the plane of the comber boards 8, 8′, 8″ are to bisect the angle which is formed by two mutually adjacent connecting rods 6, 6′, 6″ or 6‴. This is achieved by a spring 17 consisting of a spring lamina or spring wire which is fixedly connected to the shaft member 15, the ends of which spring lamina or spring wire are bent and engage the same side of the mutually adjacent connecting rods. If the two bent ends are spaced the same distance from the shaft member 15, the spring element 17 will always adjust immediately automatically with respect to the angle between the connecting rods. The plane of the comber boards 8, 8′, 8″ are positioned perpendicularly with respect to the longitudinal direction of the spring element 17.

Each comber board 8′, 8″ has at least as many guide bores therein as harness cords which form the harness. A portion of these bores 80 lie in the axis of the shaft member 15, namely on the center line of the comber boards. A different portion of the bores 80′ and 80″ are off center, namely each is spaced at the same distance from the center line or axis of the shaft member 15.

A portion of the pulls or cords 9 are each guided through the bores 80. A rotary movement of the joints 7 does not effect the length of these cords. The other cords 9′, 9″, 9‴ and 9⁗ are guided from one comber board to the next each through one of the bores of the left row of bores 80′ and then through one of the right row 80″ of bores, as this is clearly illustrated in FIGS. 3 and 4. All cords intersect at X and also Y. In order to prevent a frictional contact or hindrance between the individual cords, the bores 80, 80′ and 80″ are also staggered in the height. The guide bores of the series arranged comber boards are related with one another so that they are at a mirror image with respect to a connecting plane extending through the center lines or axes of the shaft members 15 of said comber boards 8, 8′, 8″. If the harness guide system is pivoted in the joints 7, the entire length, namely the spacing between the first and the last comber boards for the individual harness cords 9, 9′, 9″, 9‴ and 9⁗ remains practically the same, because the one series of guide bores are oriented at an angle on the inside of one comber board and on the outside on the next guide bore. FIG. 4 shows only a portion of the total number of possible cords.

Thus the described arrangement makes it possible to move the carrier rod 10 horizontally without causing a change in the distance "*a*" between the thread guides 14. This adjustment can change the distance "*b*" after releasing the lock of the joint 7 by loosening the screw nut 16, whereby the harness guide systems consisting of connecting rods 6, joints 7 and comber boards 8, assumes automatically a new position.

It is possible to connect in a harness guide system, for example the harness guide system 5, two or more connecting rods 60,60′ having an intermediate joint 70, the shaft of which does not have a comber board thereon, so that, with the aid of a stronger or weaker adjustment of the joint 70, the height "*a*" of all participating thread guides 14 can be adjusted collectively and without necessitating an adjustment of the height of the carrier rod 10. The same effect is created when a connecting rod is adjusted in length with known means.

The intermediate joint 70 permits a movement in the longitudinal direction of the rods and/or in a direction of rotation relative to the rods.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a harness of a weaving machine having heddles and a movable harness therein, wherein the spacing of the heddles are movable and adjustable preferable in the width of the machine to facilitiate an adjustment of the width of the selected material, wherein the movable harness has in the path of the harness cords a plurality of series arranged and spaced comber boards which are arranged one behind the other and having a guide bore per harness cord therein, the improvement comprising a connection between each pair of series arranged comber boards which consists of at least one rigid, namely bend-resistant connecting rod which is pivotally interconnected through a pivotal joint connection to an adjacent connecting rod, said pivotal joint being located adjacent each of the comber boards so that a center line of each comber board coincides with the pivot axis of the pivotal joint connection, each of the comber boards having a plurality of guide bores therein which are series arranged and have a harness cord extending therethrough with the guide bores in alternating ones of said comber boards having a mirror image relationship to the bores in the next adjacent comber board said guide bores in each of said comber boards being symmetrical to a plane connecting the center lines of the comber boards.

2. The improved Jacquard-harness according to claim 1, including means for moving and holding the plane of the comber boards into a position bisecting the angle formed by the mutually adjacent connecting rods to said comber board.

3. The improved Jacquard-harness according to claim 2, wherein said means consist of a lamina or wire spring which is fixedly connected to a shaft defining said pivotal joint or to the comber board and the ends of the spring are in active connection with the mutually adjacent connecting rods at equal distances on both sides of the comber board.

4. The improved Jacquard-harness according to claim 2, wherein said harness cords intersect between two adjacent comber boards at different heights in the connecting plane between said comber boards.

5. The improved Jacquard-harness according to claim 1, wherein each of the guide bores of adjacent comber boards are associated with a harness cord and a portion of the guide bores lies in the center axis of said comber boards.

6. The improved Jacquard-harness according to claim 1, wherein the pivotal joints between adjacent connecting rods consist of a shaft which is perpendicular to the rods, said rods having bearing housings secured thereto receiving said shaft therein and wherein said shaft is secured to the comber board.

7. The improved Jacquard-harness according to claim 1, wherein the pivotal joints include means for locking the pivotal joint between the connecting rods.

8. The improved Jacquard-harness according to claim 1, wherein at least one connecting rod is divided by at least one lockable intermediate joint which does not have a comber board thereon and which permits a movement in the longitudinal direction of the rod and/or in direction of rotation thereto.

* * * * *